US007717306B2

(12) United States Patent
White, Sr.

(10) Patent No.: US 7,717,306 B2
(45) Date of Patent: May 18, 2010

(54) TWO-AXIS TRIGGER ACTUATOR

(76) Inventor: Davis Asbury White, Sr., 1539 Hobbs Dr., Summerton, SC (US) 29148

( * ) Notice: Subject to any disclaimer, the term of this patent is extended or adjusted under 35 U.S.C. 154(b) by 30 days.

(21) Appl. No.: 12/088,630

(22) PCT Filed: Jul. 18, 2006

(86) PCT No.: PCT/US2006/027709

§ 371 (c)(1),
(2), (4) Date: Jun. 2, 2008

(87) PCT Pub. No.: WO2007/040720

PCT Pub. Date: Apr. 12, 2007

(65) Prior Publication Data

US 2008/0230631 A1 Sep. 25, 2008

Related U.S. Application Data

(60) Provisional application No. 60/596,491, filed on Sep. 28, 2005.

(51) Int. Cl.
*A62C 11/00* (2006.01)

(52) U.S. Cl. ..... 222/474; 222/321.8; 222/402.15; 222/469; 222/472; 239/333; 239/537

(58) Field of Classification Search ..... 222/469, 222/470, 472, 321.7, 321.8, 402.15, 473, 222/474, 548–550, 556; 239/329, 337, 333, 239/375, 537, 538
See application file for complete search history.

(56) References Cited

U.S. PATENT DOCUMENTS

| | | | | | |
|---|---|---|---|---|---|
| 2,453,974 | A * | 11/1948 | Colaluca | ..... | 215/3 |
| 2,490,194 | A * | 12/1949 | Barclay | ..... | 222/470 |
| 3,650,473 | A | 3/1972 | Malone | ..... | 239/333 |
| 4,503,998 | A | 3/1985 | Martin | ..... | 222/341 |
| 5,492,275 | A | 2/1996 | Crampton | ..... | 239/333 |
| 6,003,738 | A | 12/1999 | Foster et al. | ..... | 222/384 |
| 6,029,862 | A * | 2/2000 | Jones | ..... | 222/402.11 |
| 6,964,381 | B2 * | 11/2005 | Stradella et al. | ..... | 239/333 |

* cited by examiner

*Primary Examiner*—J. Casimer Jacyna
(74) *Attorney, Agent, or Firm*—Michael A. Mann; Nexsen Pruet, LLC

(57) ABSTRACT

The invention is a dual-axis force transmission mechanism that operates as an actuator for the valve of fluid dispensing devices. It comprises a rotating trigger member (101) that pivots as a force is applied by the operator. The transmission mechanism preferably includes a rack and pinion arrangement in which a pinion gear (108) located on the rotatable trigger member (101) intermeshes with a rack gear (107) located on the opposing force transmission frame. This mechanism inter-converts a force applied to the rotatable trigger (101) into a rectilinear force that is then transmitted to operate the fluid dispensing valve.

13 Claims, 7 Drawing Sheets

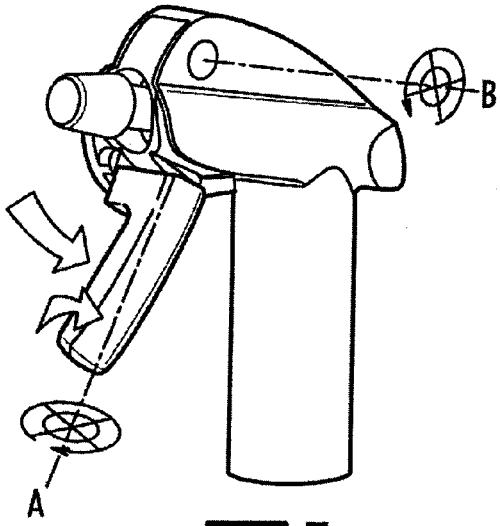
FIG.5A
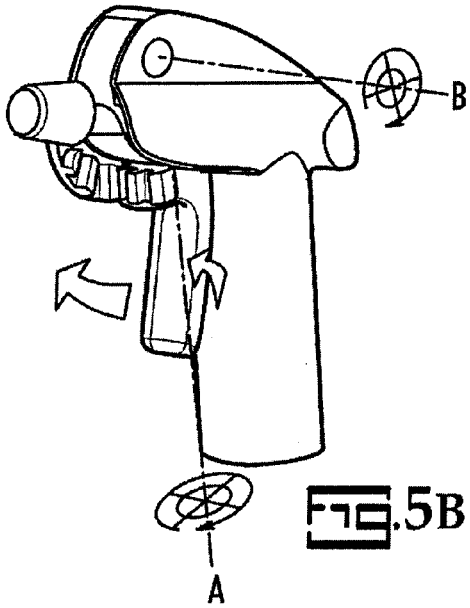
FIG.5B
FIG.5C
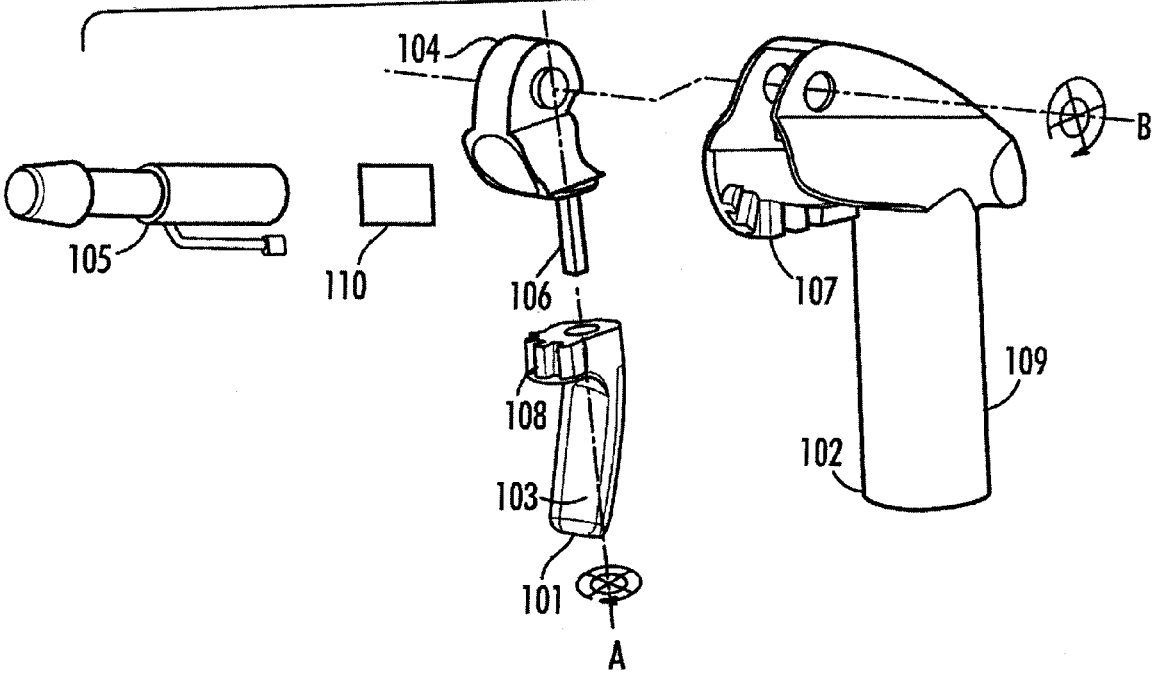

TWO-AXIS TRIGGER ACTUATOR

RELATED APPLICATION

This application claims the benefit of U.S. Provisional Patent Application Ser. No. 60/596,491, filed Sep. 28, 2005, and PCT Application Serial No. PCT/US06/27709, filed Jul. 18, 2006, which are incorporated in their entirety herein.

BACKGROUND OF INVENTION

Numerous types of trigger mechanisms for fluid dispensers exist in the art. These triggers are usually operated by a single hand. Such triggers are in use on fuel pump nozzles, on hand actuated pump sprayers, and on hand actuated pressurized sprayers such as the common pressure washer to name a few. These fluid dispensers sometimes are releasing fluid that is contained in a pressurized storage device or supplied under pressure by a pump or supplied from a gravity fed system. The art of trigger design for such fluid dispensing devices is characterized by a single axis trigger which when actuated by the hand of the operator rotates in a single plane about the aforementioned axis by an inward pivot toward the handle and an outward pivot away from the handle. When the operator holds the dispenser by the handle and applies a force to the trigger causing the inward pivot toward the handle, a valve mechanism in the fluid dispenser is engaged and the pressurized fluid is released. When the operator ceases the application of the force to the trigger, a return mechanism causes the trigger to return to its initial resting position at the end of the outward pivot away from the handle and the valve mechanism ceases to be engaged and is closed by its own return mechanism or by the force of the fluid pressure or by both.

These single axis triggers have been known in the art for a long time and have been improved over the years by the addition of various ergonomic or styled grip designs and locking mechanisms, all with the intent to relieve some of the stress created by the high force demands on the hand of the operator. A relatively high user engagement force has been required to overcome the force of the return mechanism and friction. In particular, the trigger return mechanism force must be high to assure that the trigger lever returns to the fully open position, which position results in the valve being closed when the trigger is released. High force demands placed on the hand can cause discomfort, fatigue, and musculoskeletal disorders. Unfortunately, though some improvements have been made as noted above, these hand-stress disorders (resulting from repeated trigger operation, continuous trigger hold down, or a mixture of both during ordinary use of fluid dispensing triggers) remain a critical problem in the art. Thus, it is desirable to provide an improved trigger lever that can actuate the fluid dispenser and reduce the amount of hand-stress the operator experiences. It is in this light that the present invention seeks to relieve stress on the hand through implementation of an improved force transmission device.

SUMMARY OF THE INVENTION

The present invention relates to a type of trigger mechanism for a fluid dispenser that operates through partial rotation around two axes, and arcuate or rotational motion of the trigger is converted into rectilinear force that boosts the power as the trigger is pivoted inward by the gripping force of a hand of an operator. The trigger mechanism consists of a rotatable lever and a pivotable joint wherein, when an operator holds the fluid dispenser by a handle and squeezes the trigger mechanism, a force applied is transmitted to a valve mechanism. The discomfort, fatigue, and musculoskeletal disorders commonly associated with operation of hand actuated fluid dispensers, especially when there are repetitive and sustained lever depressions over time, are greatly reduced with the novel trigger mechanism.

BRIEF DESCRIPTION OF THE FIGURES

FIGS. 5A, 5B and 5C show the parts of a typical novel spray mechanism.

DETAILED DESCRIPTION OF THE INVENTION

The present invention is designed to lessen the occurrence of user discomfort, fatigue, and possible musculoskeletal disorders through an improved force transmission mechanism for a control device, such as a valve mechanism for dispensing fluid. One application of the present invention relates generally to an improved hand-actuated trigger mechanism for fluid dispensers. More specifically, the present invention relates to a dual-axis type of trigger mechanism for a fluid dispenser that utilizes a trigger or trigger lever that pivots around both the standard single axis that is common in the existing art and an additional axis that is generally aligned with the length of the trigger lever. Such trigger mechanism utilizes a rotatable lever with a pivotable joint wherein a force applied is transmitted to a valve mechanism or a fluid dispensing valve assembly.

Figure 1A:
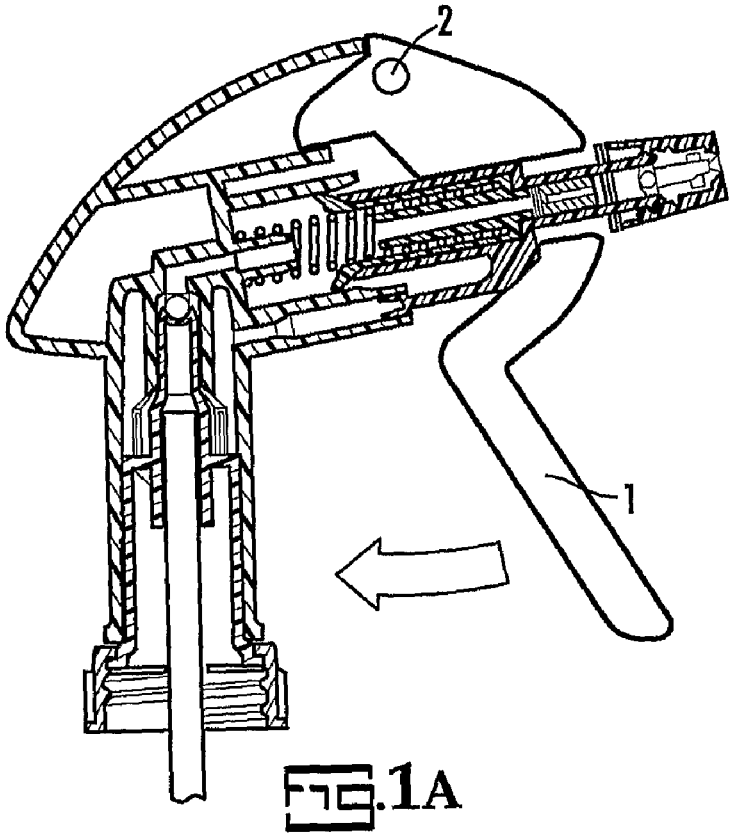
FIG. 1A PRIOR ART
FIGS. 1A and 1B represent prior art trigger sprayers.
Figure 1B:
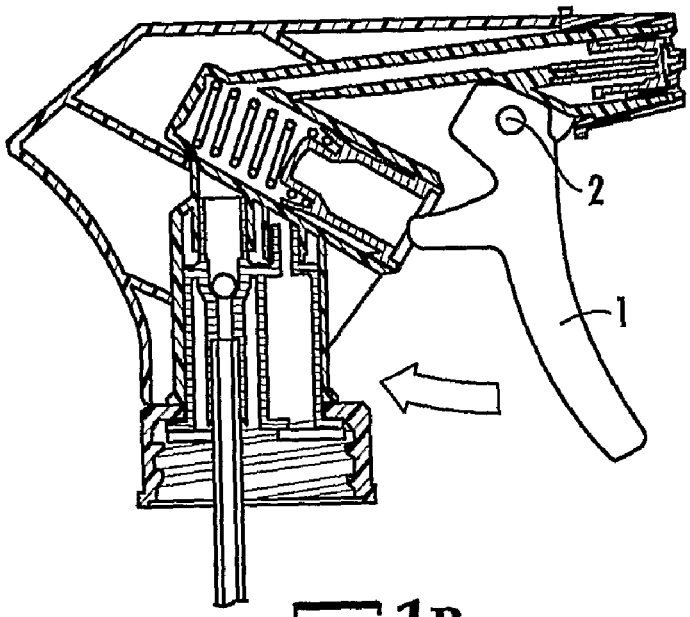
FIG. 1B PRIOR ART

Numerous types of trigger mechanisms for fluid dispensers exist in the prior art. Examples are shown in FIGS. 1A and 1B, which show the single pivot trigger 1, with the pivot 2 shown either above or below the valve assembly. The figures also show the single direction of movement of the trigger. As noted above, discomfort, fatigue, and musculoskeletal disorders are commonly associated with operation of hand actuated fluid dispensers, especially when there are repetitive and sustained lever depressions over time. Typically this is because the fluids are delivered under pressure and thus considerable force is required to open and hold open the valve that allows the fluid to be dispensed. Also, a trigger return mechanism such as a spring 110 or similarly functioning item will typically be included in such trigger actuated dispensers to ensure that, upon release of the trigger, it returns to its original resting position and thus allows the valve to close. Further objects and advantages of the invention will become apparent from a consideration of the drawings and ensuing detailed description.

A primary characteristic of the improved force transmission trigger mechanism is that arcuate or rotational motion of the trigger is converted into rectilinear force that boosts the power as the trigger is pivoted inward by the gripping force of a hand of an operator. That is, by interconverting a rotation force imparted to the dual-axis trigger into a rectilinear force, the necessary input force required to actuate a trigger lever on a fluid dispenser appears to the operator to thereby be decreased. This apparent decrease in necessarily applied force is made possible by translating energy that would otherwise be wasted on kinetic friction between the fingers and the trigger present in the current art into additional force applied on the release valve during actuation of the trigger. Further, this force transmission mechanism is able to reduce the occurrence of various hand-stress disorders through several means including: facilitating a more natural or arcuate hand motion during trigger actuation, decreasing the net force necessarily applied by the user, decreasing the peak force necessarily applied by the user, distributing the force necessarily applied by the user to each finger engaged in actuating the trigger in a manner proportional to the tolerable stress levels of each finger, and optimizing force distribution necessarily applied by the finger(s) of the user over the time of trigger rotation. Further, this rotational movement of the trigger facilitates a more comfortable engaged trigger position when uninterrupted trigger depression is required, thus reducing or eliminating the need to reposition the user's hand position from the initial clasp to the final, fully gripped position.

Figure 3A:
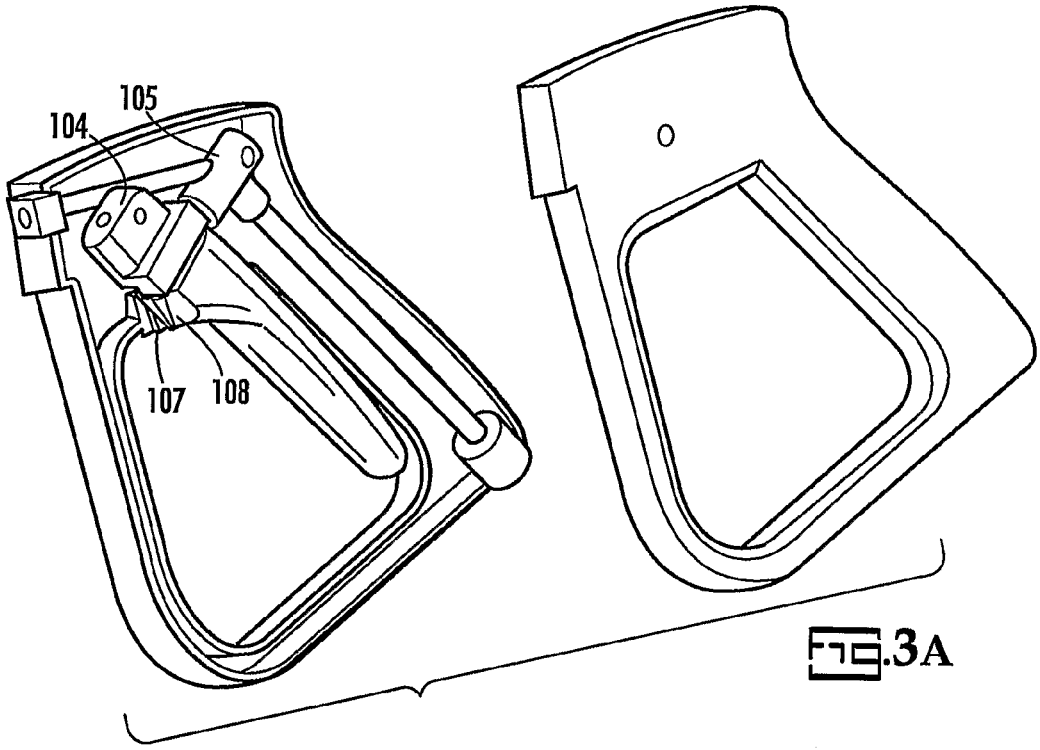
FIG. 3A shows one embodiment of the novel spray mechanism in a partially exploded view with one cover of the spray mechanism removed.
Figure 3B:
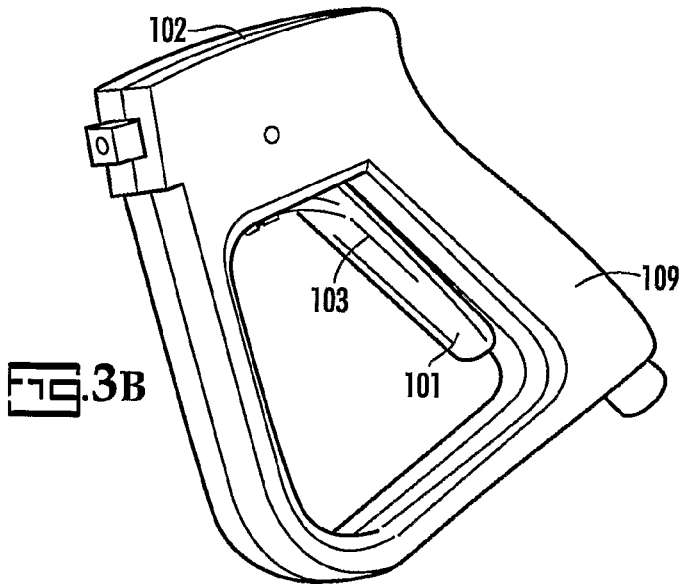
FIG. 3B shows one embodiment of the intact novel spray mechanism.
Figure 4:
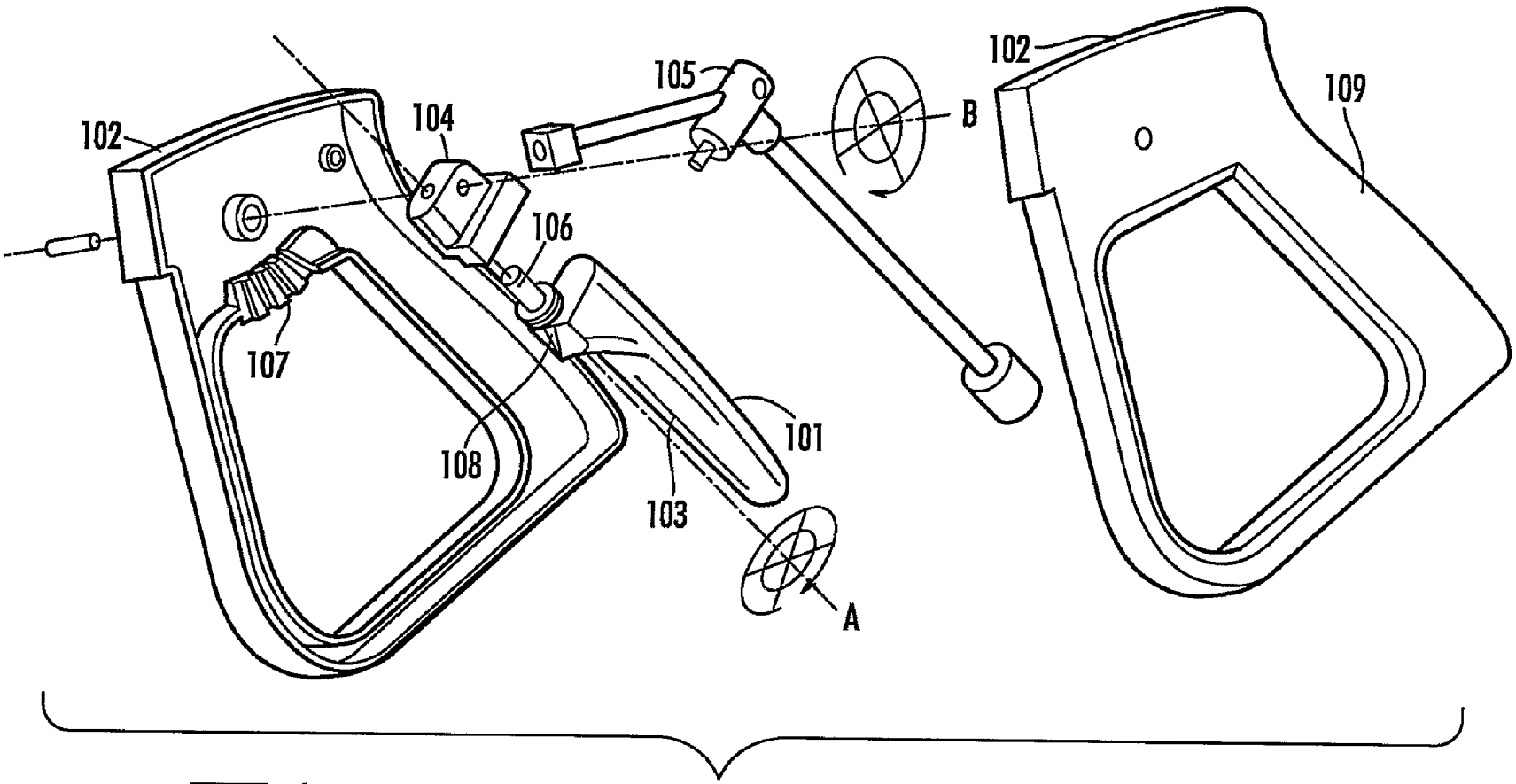
FIG. 4 shows one embodiment of the novel spray mechanism in an exploded view with the trigger lever in the fully gripped and thus fully rotated position and with the direction of axial rotation depicted for the trigger once it is released.

A representative example of the novel control valve can be seen in FIGS. 5A, 5B, and 5C. A housing frame or force transmission mechanism frame 102 serves as the structural support for the mechanism. Included with the frame is a gear (rack gear) 107. Attached to the frame is a pivoting actuator 104, to which is attached via a rotation shaft 106 a trigger lever 101 having a gear (pinion gear) 108. 109 is a gripping surface for palm and thumb of the operator. The housing frame can alternatively incorporate an attachable shroud, or cover, which would act as the gripping surface or the shroud could alternatively include the gear (rack gear) 107. An optional grasping surface (or grip portion) of the trigger lever is depicted as 103. The force developed by the trigger mechanism dispenses fluid from the fluid chamber 105, which contains a valve and piston mechanism. Partially exploded and exploded views of the mechanism are shown in FIGS. 3A and 4, respectively.

It should be noted that various types of valve assemblies can be used, and the valve mechanism can consist of one valve or multiple valves. The valve can optionally contain piston and shaft systems and a nozzle.

Figures 6A, 6B, 6C:
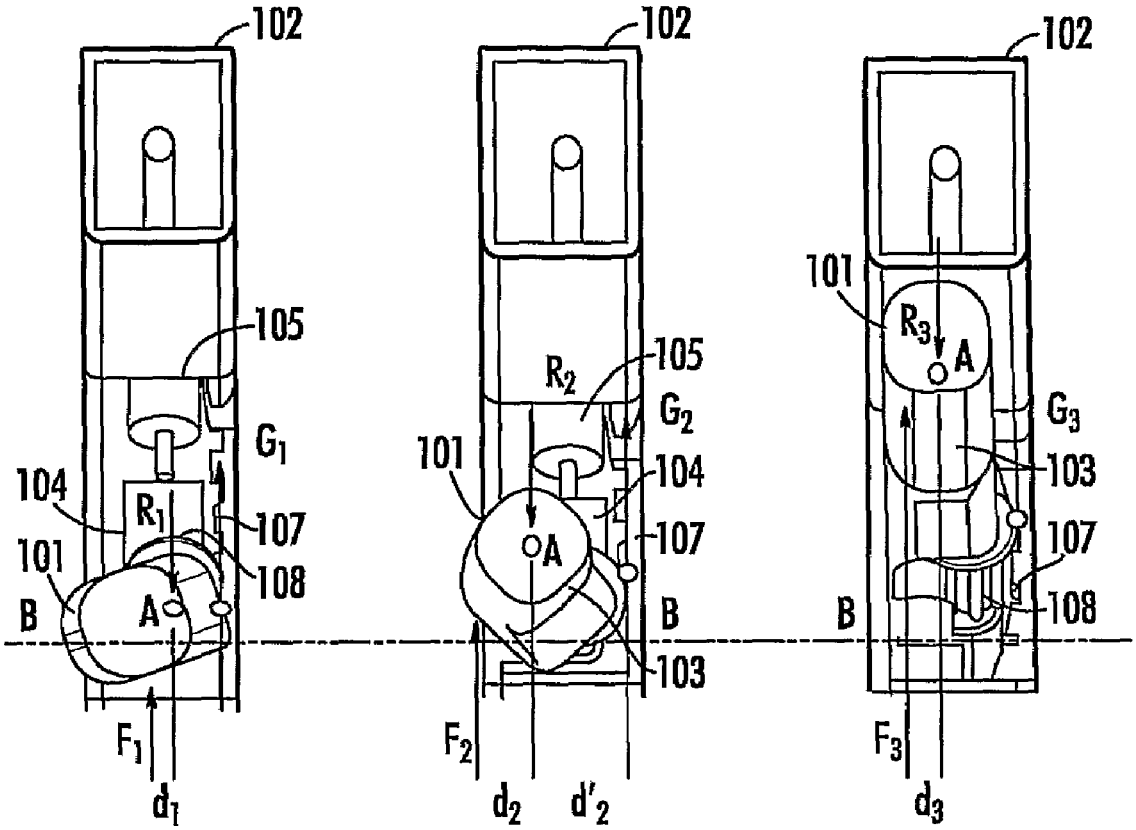
FIGS. 6A, 6B and 6C show the progression of bottom views of the handle as the handle releases fluid via the mechanism.

The force of the trigger in the mechanism releases fluid as follows. In FIGS. 5A and 5B, the interconversion of the rotation force applied to the trigger 101 into a rectilinear force is accomplished by drawing the trigger 101 to the housing frame handle 102 with the handle being rotated along axis A (shown in FIG. 5C) and moved in a translational direction towards the handle along axis B. Thus the trigger acts along two axes, both pivotally and rotatably, and transmits force to actuate the fluid dispensing valve. FIGS. 6A, 6B and 6C are bottom views of the trigger assembly looking upward along the A-axis. The views illustrate the trigger in the un-engaged (FIG. 6A), partially engaged (FIG. 6B), and fully engaged (FIG. 6C) positions. Applied forces $F_1$, $F_2$ and $F_3$ are shown acting on grasping surface 103 at the center of the holder's one or more fingers bearing against trigger 101. For purposes of illustration, assume that forces applied by the hand are equal throughout trigger action, $F_1=F_2=F_3$. Trigger 101 is configured not only to pivot about axis B, drawing trigger 101 closer to the dispenser housing handle, but also to rotate about axis A, moving the trigger along the frame housing 102. Both left-handed and right-handed versions of the control device are possible, with the right-handed version generally moving counter clockwise when viewed from above, and the left-handed version generally moving clockwise when viewed from above. In order to achieve this compound motion, trigger 101 must be configured to cause the load applied by the holder's fingers to shift off-center with respect to rotation axis A during trigger pull, thereby generating the rectilinear force. This rectilinear force is transferred through the pivoting actuator 104 to the valve and piston assembly inside a fluid chamber 105 thereby discharging fluid. In the unengaged trigger position of FIG. 6A, applied load $F_1$ acts substantially in-line with axis A, generating an equal and opposite reaction force $R_1$ at a hinge 106 (see FIG. 5C) concentric with axis A. Because $F_1$ is not eccentric with respect to $R_1$ (i.e. $d_1=0$), a counterbalancing force is not necessary (i.e. $G_1=0$). Alternatively, the applied load $F_1$ may begin eccentrically with respect to $R_1$ if sufficient grip is available and limited movement is required. In the partially deflected trigger position as depicted in FIG. 6B, however, rotation of trigger 101 has shifted applied load $F_2$ to a new position that is offset from axis A by a distance $d_2$. This load offset causes a rotational imbalance that is counterbalanced by a force $G_2$ acting at a distance $d'_2$ from axis A (i.e. $F_2d_2=G_2d'_2$). The induced counterbalancing or leveraging force $G_2$ in turn drives up the force $R_2$ acting at hinge 106 (shown most clearly in FIG. 5C) in order to preserve the load balance (i.e. $R_2=F_2+G_2$) on the trigger 101. In other words, by offsetting the same applied force $F_2=F_1$ from the rotation axis A, the hinge force $R_2$ is increased by an amount $G_2$, $G_2$ being the rectilinear force generated by the offset rotation moment $F_2d_2$. Likewise in FIG. 6C, constant applied load $F_3=F_2=F_1$ is now further offset by a larger eccentricity $d_3$ with respect to rotation axis B thereby generating an even greater counterbalancing force $G_3>G_2$ and inducing a larger hinge force $R_3$.

Some dispenser systems have a trigger pull reaction force RN that increases until overcoming a peak requirement, as when opening a pressurized valve, and then decreases, $R_1<R_2>R_3$. In these circumstances, $d_N$ would not necessarily have to gradually increase to a maximum value at the fully engaged position, but could rather alternate the leverage distance, and peak in the center of the stroke, $d_1<d_2>d_3$.

Boosted hinge force $R_3$ provides additional mechanical advantage in comparison with conventional, single axis triggers, enabling the user to generate greater trigger pull power and, as applied to dispensers, the desired trigger feel. The leverage around axes B and A compound to provide a multiple mechanical advantage not possible in a single-axis trigger.

Figure 2A:
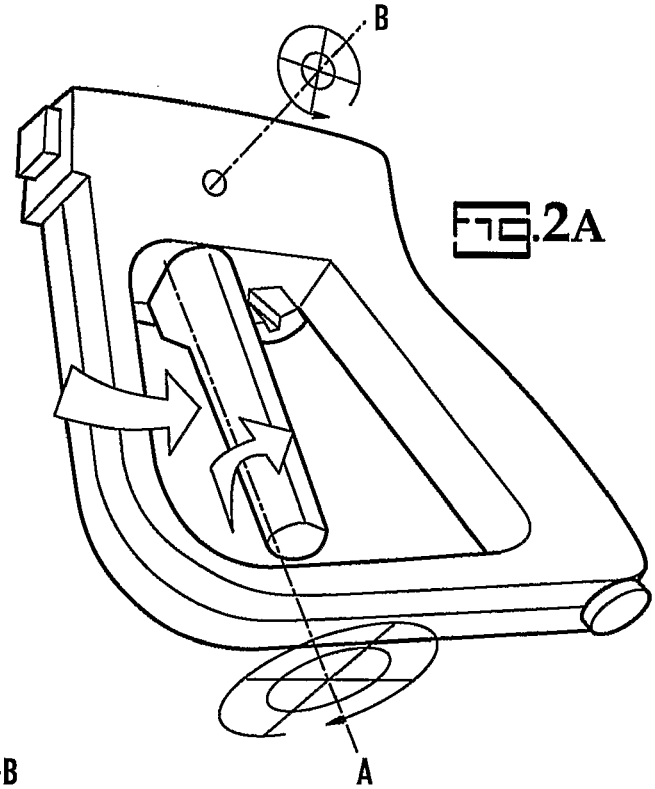
FIG. 2A is a perspective view showing the motion of one embodiment of the novel spray mechanism in dispensing the fluid.
Figure 2B:
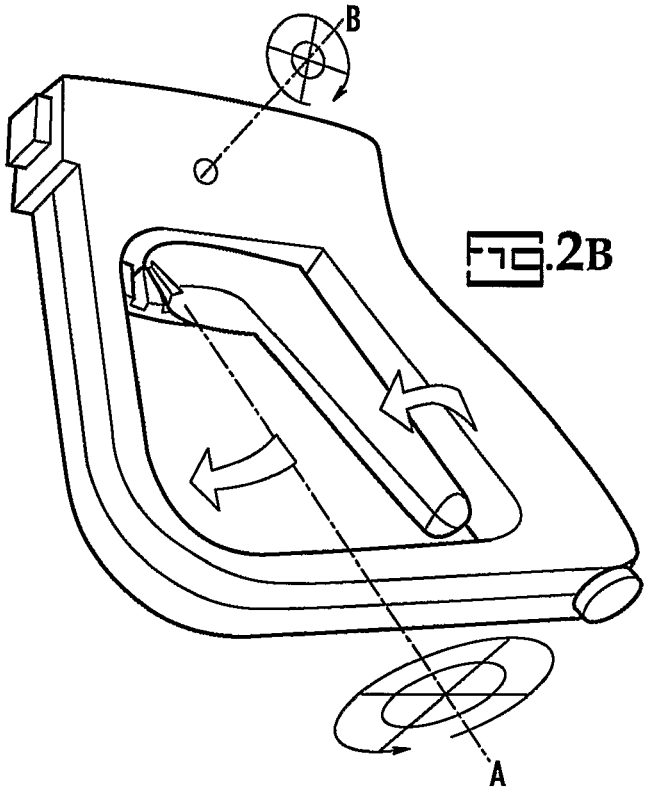
FIG. 2B is a perspective view showing the motion of one embodiment of the novel spray mechanism in return of the spray to its original position. The figures depict the two axes and the direction of rotation of the trigger lever around each of the axes.

The motion of the trigger lever and its return to its original position is shown in FIGS. 2A and 2B.

Variations in the above analysis will apply to alternatives of the novel control device that are contemplated by this invention. The following exemplary embodiment is provided to further illustrate the invention and is not to be construed to unduly limit the scope of the invention.

The preferred embodiment of the present invention contemplates an improved force transmission mechanism attached to a fluid dispensing device. In this embodiment, an elongated trigger lever has a gripping surface that is asymmetric in shape when viewed with reference to its rotational axis. The lever rotates in an arc around its rotational axis while also pivoting about a pivotal axis when gripped by the hand of an operator and thereby engages and opens the valve of the fluid dispensing device. The asymmetrical gripping surface can either incorporate the rotational axis within the trigger lever body or asymmetrically offset the lever from the rotational axis. The rotational and pivotal axes are necessarily perpendicular. Further, the transmission mechanism includes a rack and pinion arrangement in which a pinion located on the upper end of the rotatable trigger intermeshes with a rack located on an opposing portion of the dispenser frame body.

The rotatable trigger member of the force transmission mechanism in this embodiment is elongated along the rotational axis and is ergonomically designed to accommodate as many as four fingers. It has a lower end that is free and unattached and an upper end that forms the point of connection to the rest of the force transmission mechanism. On this upper end, there is first an optional geared engagement connection to the force transmission mechanism frame and second a rotation connection to the pivoting actuator. The rack and pinion connection is formed by a pinion on the rotatable trigger member which intermeshes with a rack located on the force transmission mechanism frame. The rack and pinion engage as the rotatable trigger member is pivoted. Other mechanisms aside from rack and pinion gears can also be used to transmit movement of the trigger into a force for releasing the fluid from the valve.

The rotation of the rotatable trigger member occurs via the rotation connection to the pivoting actuator. A rotation connection, as used here, is any type connection that allows the rotatable trigger member to rotate about its rotational axis while remaining attached to the pivoting actuator. One possible embodiment of such a rotation connection is accomplished via an axial shaft which rotates within a cylindrical cavity.

The pivoting actuator member is designed to be the point of actuation between the rotatable trigger member and the fluid dispensing valve. When the rotatable trigger member is operated, the pivoting actuator member engages the fluid dispensing valve. Thus, the pivoting actuator pivots from a rest position when the valve is not engaged and then pivots to a full operation position when the valve is fully engaged. When the operator releases the force applied to the trigger lever, a spring mechanism returns the pivoting actuator to the rest position. The return spring may be separately anchored and attached directly to the pivoting actuator or integrated into the valve assembly which translates the return force through the valve needle that engages the pivoting actuator.

The pivoting actuator member is attached via a rotation connection to the upper end of the rotatable trigger member. The pivoting actuator is also pivotally attached to the force transmission mechanism frame. This pivotal connection allows the pivoting actuator member and the rotatably attached rotatable trigger member to pivot about the pivotal axis. Engaging the pivoting actuator is a mechanically linked valve assembly which is secured to the transmission mechanism frame. The spring return mechanism located within the valve assembly acts to return the pivoting actuator member and its rotatably attached rotatable trigger member to the rest position.

There can be both right-handed and left-handed versions of this invention. In the right-handed version of this embodiment, when the rotatable trigger member is operated by an applied force such that the rotatable trigger member and the pivoting actuator member pivot from the rest position to the full operation position, the rotatable trigger member rotates in the counterclockwise direction from a top view perspective. Accordingly, when the rotatable trigger member is released, it pivots back to the rest position and, in doing so, rotates in the clockwise direction from a top view perspective. This motion would be reversed in a left-handed embodiment.

Figure 8:
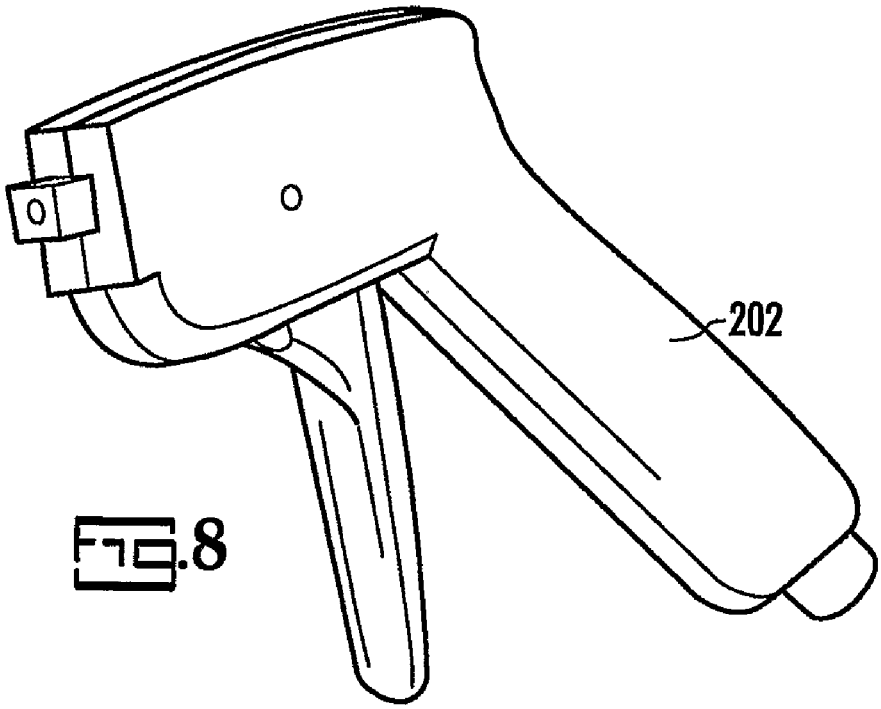
FIG. 8 is a perspective view of a further alternative embodiment of the invention in a fluid dispensing mechanism without a trigger guard for use in device applications where the trigger guard is not necessary or desired.

Another variation relates to whether the fluid is under pressure or requires manual force to dispense the fluid. The novel control device works equally well with either type of fluid and also to other variations in types of fluid (e.g. variations in viscosity; gases as well as liquids). Another variation relates to the inclusion or exclusion of a trigger guard. (See FIG. 8 for a version without a guard. Part 202 shows the housing without a trigger guard.)

Finally, the force transmission mechanism frame is rather rigid in construction and is the stable point of attachment for various members in this embodiment. The pinion located on the rotatable trigger member engages a rack located on the force transmission frame. The pivoting actuator member is pivotally attached to said force transmission mechanism frame, and, the valve assembly with integrated spring return mechanism is attached to said force transmission mechanism frame. In this embodiment, said force transmission mechanism frame also houses the fluid dispensing valve and associated fluid conduits. In this embodiment, a portion of the force transmission mechanism frame also serves the function of a trigger guard for the rotatable trigger member. The force transmission mechanism frame extends beyond the path that the rotatable trigger member takes in pivoting from the rest to the engaged position. Thus, the trigger guard portion of the force transmission mechanism frame forms a loop around the pivotal path of the rotatable trigger member to prevent accidental engagement. This feature is not essential and alternate embodiments may or may not include it.

A further element of the force transmission mechanism frame is to provide a control means by which the operator can grip and control the force transmission mechanism. Therefore, the part of the force transmission mechanism frame that is opposed to the rotatable trigger member is ergonomically designed to accommodate the palm and thumb of the hand and is generally referred to as the handle of the fluid dispensing mechanism.

Another alternate embodiment also includes a safety feature comprising a trigger lock. This feature is intended to retain the trigger at rest in the non-engaged position in order to prevent unintentional usage. In one embodiment, the safety lock mechanism is housed within the rotatable trigger and can be activated by translating or rotating a retention tab. The activation of this retention tab mechanically engages either the housing frame or pivoting actuator preventing movement of the trigger lever within the fluid dispenser assembly mechanism in a manner that would lead to engagement of the fluid release valve.

Another alternate embodiment also includes a hold down feature comprising a different form of trigger lock. This feature is intended to retain the trigger at rest in the engaged position in order to facilitate continuous operation. In one embodiment, the trigger retention mechanism is housed within the rotatable trigger and can be activated by translating or rotating a retention tab. The activation of this retention tab mechanically engages either the housing frame or pivoting actuator preventing movement of the trigger lever within the fluid dispenser assembly mechanism that would lead to disengagement of the fluid release valve.

Figure 7:
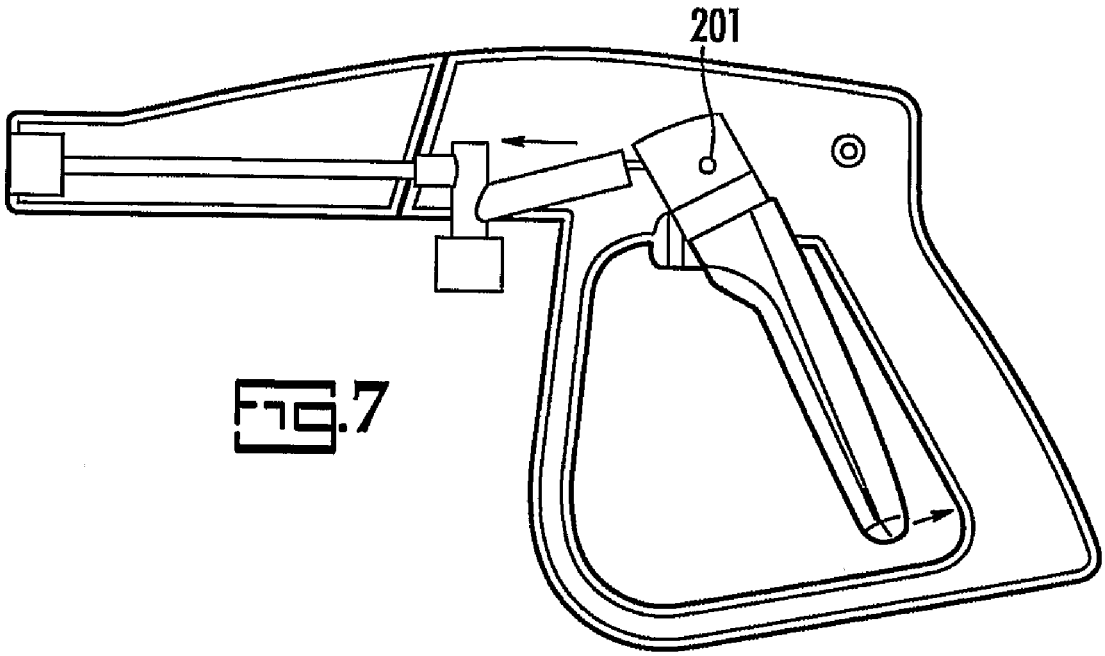
FIG. 7 is a side cut away view of an alternative embodiment of the present invention in a different fluid dispensing mechanism where the valve engagement occurs as a result of the forward tilt of the portion of the pivoting actuator that is moving in the opposite rotational direction of the trigger key.

A further alternative is a fluid dispensing mechanism where the valve engagement occurs as a result of the forward tilt of the portion of the pivoting actuator that is moving in the opposite rotational direction of the trigger key. (In FIG. 7, see the pivot 201, along with arrows showing the direction of movement of the trigger and actuator.)

The invention also includes the process for dispensing fluid from a valve by using any of the control devices disclosed herein.

It is to be understood by one of ordinary skill in the art that the present discussion is a description of exemplary embodiments only, and is not intended as limiting the broader aspects of the present invention.

I claim:

1. A control device for dispensing fluid from a valve, comprising:

(a). a frame having a non-rotatable force transmission mechanism frame;

(b). a dual axis trigger pivotally and rotatably attached to said force transmission mechanism frame about a pivot axis, said trigger rotatable in a rotatable direction about a rotation axis while said trigger pivots about said pivot axis;

(c). a fluid dispensing valve assembly connected to said trigger; and (d). a stationary nozzle, such that said force transmission mechanism frame coupled to said trigger is capable of translating a moment of a first rotational force applied to said trigger into a second force drawing said trigger about said pivot axis toward said fluid dispensing valve assembly; and, when said trigger is pivotally and rotatably activated, said valve is engaged and fluid is dispensed from said valve, wherein a gear mechanism on said force transmission mechanism frame is a stationary rack gear and a gear mechanism on said trigger is a pinion gear that pivots and rotates about two perpendicular axes.

2. The control devise of claim 1, wherein said fluid dispensing valve assembly comprises one or more valves.

3. The control device of claim 1, wherein said fluid dispensing valve assembly optionally comprises one or more components selected from the group consisting of (a) a piston and shaft system and (b) a nozzle.

4. The control device of claim 1 wherein said fluid dispensing valve assembly is rigidly mounted within said force transmission mechanism frame and moveably interlocks with said force transmission mechanism frame.

5. The control device of claim 1 wherein the direction of rotation movement of said dual-axis trigger is offset from, and not parallel to, the direction of pivotal movement.

6. The control device of claim 1, wherein said fluid is under pressure.

7. The control device of claim 1, wherein manual pumping is required for dispensing said fluid.

8. The control device of claim 1 further comprising a spring return mechanism connected to said trigger and connected to said force transmission mechanism frame, said spring return mechanism returning said trigger to a rest position after said fluid dispensing valve assembly is disengaged.

9. The control device of claim 1, wherein said valve assembly engagement occurs as a result of a forward tilt of a portion of a pivoting actuator that is moving in the opposite rotational direction of the trigger.

10. The control device of claim 1, wherein said fluid is a liquid or a gas.

11. The control device of claim 1 further comprising a spring return mechanism connected to said trigger lever and connected to said force transmission mechanism frame, wherein said movement in a rotatable direction reduces the force necessary to overcome said spring return mechanism.

12. A control device for dispensing fluid from a valve, comprising:

(a). a force transmission mechanism frame, said frame further comprising a stationary rack gear and grip portion;

(b). a dual-axis trigger attached to said force transmission mechanism frame, said trigger moveable in a first pivotal direction while movable in a second rotatable direction perpendicular to said pivotal direction on said force transmission mechanism frame, said trigger further comprising a pinion gear stationary with respect to said trigger, said pinion gear moveable both pivotally and rotatably together with said trigger;

(c). a fluid dispensing valve assembly connected to said trigger;

(d). a stationary nozzle; and (e). a spring return mechanism connected to said trigger lever and connected to said force transmission mechanism frame, said spring return mechanism returning said trigger lever to a rest position after said fluid dispensing valve assembly is disengaged such that, when said trigger is pivotally and rotatably activated, said valve assembly is engaged and fluid is dispensed from said valve.

13. The control device of claim 12 wherein said movement in a rotatable direction reduces the force necessary to overcome said spring return mechanism.

* * * * *